US008038501B2

(12) United States Patent
Eisen

(10) Patent No.: US 8,038,501 B2
(45) Date of Patent: Oct. 18, 2011

(54) FIGURINE FOR DISPLAYING A LOCKET OF HAIR

(76) Inventor: Linda Eisen, Haworth, NJ (US)

( * ) Notice: Subject to any disclaimer, the term of this patent is extended or adjusted under 35 U.S.C. 154(b) by 85 days.

(21) Appl. No.: 12/031,748

(22) Filed: Feb. 15, 2008

(65) Prior Publication Data

US 2009/0209164 A1 Aug. 20, 2009

(51) Int. Cl.
*A63H 3/00* (2006.01)
*A63H 3/44* (2006.01)

(52) U.S. Cl. ..... 446/72; 446/394; 132/275; 132/276

(58) Field of Classification Search ..... 446/72, 446/73, 394, 390, 391, 372, 369; 132/275, 132/276

See application file for complete search history.

(56) References Cited

U.S. PATENT DOCUMENTS

| | | | | | |
|---|---|---|---|---|---|
| 2,253,635 | A | * | 8/1941 | Mann | 446/394 |
| 2,323,522 | A | * | 7/1943 | De Journette | 446/387 |
| 3,156,999 | A | * | 11/1964 | Dean et al. | 446/319 |
| 4,874,345 | A | * | 10/1989 | Dirks | 446/394 |
| 5,257,955 | A | | 11/1993 | Jones | |
| 5,299,968 | A | | 4/1994 | Bennett | |
| 5,344,356 | A | * | 9/1994 | Pizzelli et al. | 446/73 |
| 5,626,503 | A | * | 5/1997 | Heftel et al. | 446/73 |
| 5,755,116 | A | | 5/1998 | Sparacino et al. | |
| 5,842,562 | A | * | 12/1998 | Bauman | 446/73 |
| 6,019,107 | A | * | 2/2000 | Overmyer et al. | 132/53 |
| 6,120,340 | A | | 9/2000 | Zaborowski | |
| 6,446,638 | B1 | | 9/2002 | Horman | |
| 6,527,618 | B1 | | 3/2003 | Faunda et al. | |
| 2006/0141900 | A1 | | 6/2006 | Wesley | |
| 2007/0138175 | A1 | | 6/2007 | Davis | |
| 2008/0014831 | A1 | | 1/2008 | Rettberg et al. | |

* cited by examiner

*Primary Examiner* — Gene Kim
*Assistant Examiner* — Urszula M Cegielnik
(74) *Attorney, Agent, or Firm* — Maxey Law Offices, PLLC; Brittany J. Maxey

(57) ABSTRACT

A figurine for displaying a locket of hair in a simulative manner wherein the locket of hair is releasbly secured within a hair clip and the hair clip is removably attached to the top portion of a figurine's head thus simulating the figurine having a tuft of hair. The figurine may have a simulative appearance of that of a young child or baby and serves as a keepsake memento for those who wish to preserve and display a child's first locket of hair in an non-time consuming, non-complicated, and non-damaging manner.

1 Claim, 5 Drawing Sheets

FIGURINE FOR DISPLAYING A LOCKET OF HAIR

FIELD OF THE INVENTION

The present invention relates generally to an apparatus for displaying a locket of hair, and more particularly, relating to a figurine to which a locket of hair can be removably attached.

BACKGROUND OF THE INVENTION

A child's first haircut is a momentous occasion for many people, as the first locket of hair is a cherished keepsake memento. Unfortunately, often times the locket of hair is lost, misplaced or is kept in a box somewhere out of site and out of mind.

There exists various devices for displaying or storing a locket of hair. Examples of these devices are described by U.S. Pat. Nos. 5,257,955 and 5,755,166, and by U.S. patent application Ser. No. 11/643588. In U.S. Pat. No. 5,257,955 there is described an apparatus including figurine in the form of a doll or a doll's head for displaying a locket of baby hair. The locket of baby hair is irremovably and permanently affixed to the figurine with an epoxy. While this method effectively and permanently retains the locket of hair, there are several disadvantages. One, the lock of hair can not be removed from the figurine without damaging the hair, and this is a disadvantage should the figurine become damaged and is no longer usable, or if one simply desired to no longer display the locket of hair with the figurine. Second, the correct use of epoxy requires a certain level of skill and is time consuming which is undesirable for most users'.

Accordingly, there is a need for a figurine for displaying a locket of hair in a simulative manner where the locket of hair is attachable to a figurine in a non-damaging manner without requiring a special skill, that is not time consuming, and readily permits removal of the locket of hair from the figurine without damage to the locket of hair.

SUMMARY OF THE INVENTION

To achieve these and other advantages, in general, an apparatus for removably displaying a locket of hair is provided. The apparatus includes a body that may be in the form of a figurine having the simulative appearance of a young child or baby. The locket of hair is readily secured and retained by a hair clip that operates to bunch and secure at least one end of the hairs of the locket together to form a tuff of hair. The hair clip is removably attached to the head of the figurine to display the locket of hair.

In general, in one aspect, the apparatus includes a body having an exterior surface, a hair clip for releasably securing a locket of hair, and a fastening means for removably attaching the hair clip to the body, whereby the locket of hair is displayable upon the body.

In general, in another aspect, a combination is provided. The combination including a figurine in the shape of a human baby including a head having a top portion with an exterior surface, a hair clip for releasably securing a locket of hair, and a fastening means for removably attaching the hair clip to the exterior surface of the top portion of the head, whereby the locket of hair is displayed on the figurine simulating a tuff of hair on the head.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The accompanying drawings, which are included to provide further understanding of the invention and are incorporated in and constitute a part of this specification, illustrate preferred embodiments of the invention and together with the description serve to explain the principles of the invention, in which.

DETAILED DESCRIPTION OF THE INVENTION

Reference will now be made in detail to the preferred embodiments of the present invention, examples of which are illustrated in the accompanying drawings.

Figure 1:
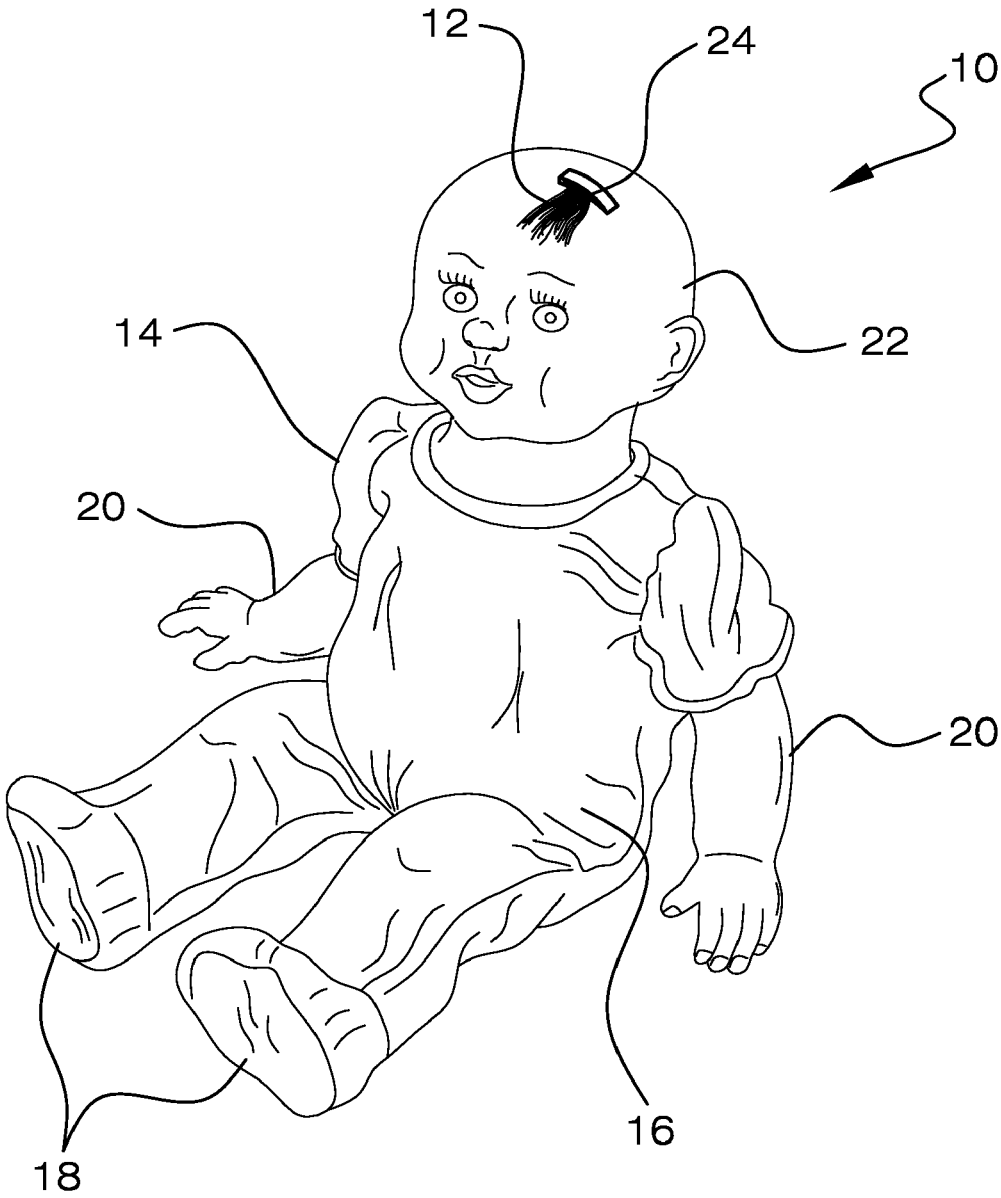
FIG. 1 is a perspective view of the apparatus for displaying a locket of hair constructed in accordance with the principles of the present invention.

Referring now to FIGS. 1-7 of the drawings, reference numeral 10 generally designates a figurine for displaying a locket of hair 12 of the present invention. In FIG. 1, the figurine 10 includes a body 14 that may be shaped to have a simulative appearance of a young child or baby. Other figurine shapes may also be possible. The body 14 may be made of various materials such as but not limited to porcelain, cotton, plastic, or thermoplastic elastomer or any combination of material suitable for the construction of a figurine for this purpose. In the example shown, the body 14 includes a torso 16, a pair of legs 18, a pair arms 20, and a head 22. The body 14 may be dressed in clothing, be painted to simulate clothing, or covered with material such as but not limited to cloth or fur.

Figure 2:
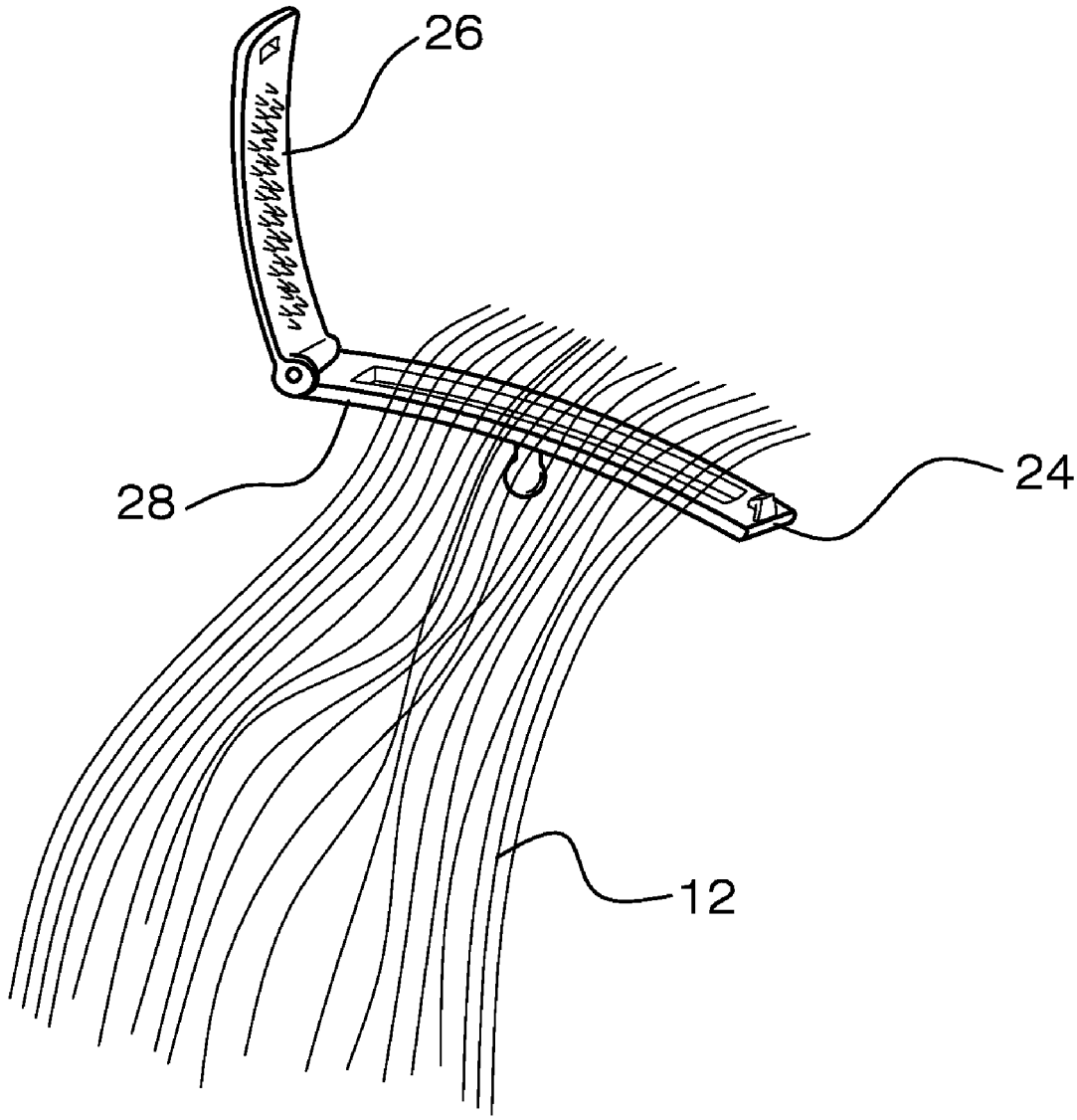
FIG. 2 is an enlarged perspective view of the hair clip for removably receiving a locket of hair for attachment to the body of apparatus for displaying a locket of hair.

The locket of hair 12 is removably received and retained by a hair clip 24. The hair clip 24 is removably attachable to the body 14. With reference to FIG. 2, the hair clip 24, may be of a standard hair barrette construction including a two clip arms 26 and 28 that are connected together for relative rotation towards and away from each other. The clip arms 26 and 28 are rotated away to permit insertion of an end of a locket of hair 12 therebetween, and then are rotated towards one another to pinch or otherwise compress the locket of hair between the two clip arms. The two clip arms 26 and 28 may be secured together with a cooperable fastener. In another variation, the two clip arms 26 and 28 could be constructed of spring metal where bending of the arms in one direction separates the arms and then bending in the opposite direction engages the arms together to pinch or sandwich a locket of hair.

Figure 3:
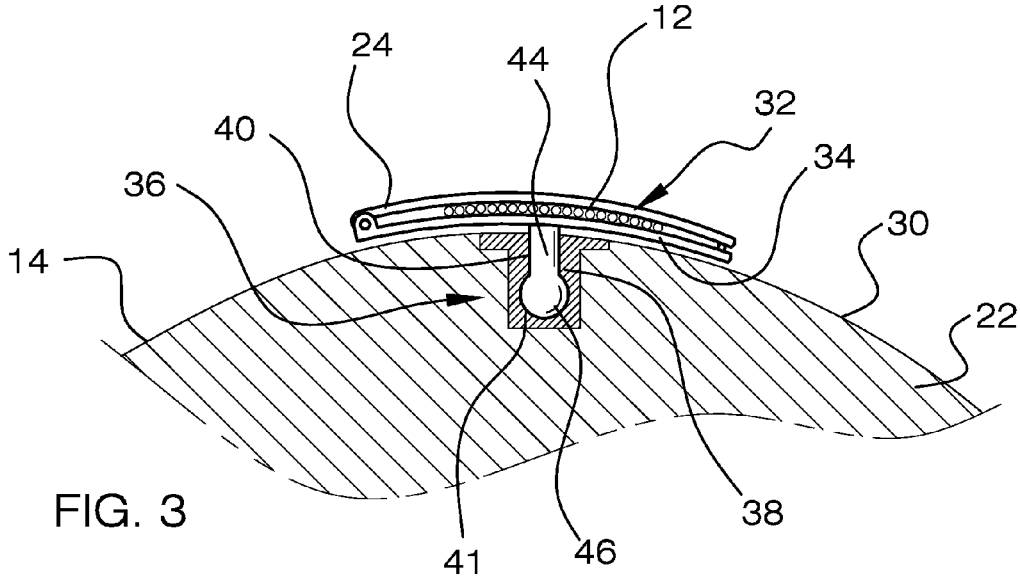
FIG. 3 is an enlarged partial cross section view through a section of the body showing a fastener removably securing the hair clip to the body of the apparatus.
Figure 4:
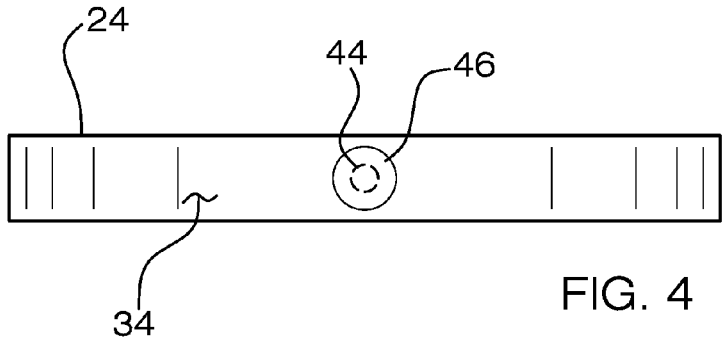
FIG. 4 is a bottom plan view the hair clip including the fastening system of FIG. 3.

With reference now to FIG. 3, there is shown a partial cross section of the body 14 through the head portion 22. The head 22 includes an exterior surface 30 upon which the locket of hair 12 is displayed. A fastening means 32 removably attaches the hair clip 24 to the head 22. It is important for the fastening means 32 to permit attachment of the hair clip 24 to the body 14 such that the bottom side 34 of the hair clip is either in direct contact with or in close proximity to the exterior surface 30 to ensure an aesthetically pleasing appearance. Otherwise, the locket of hair 12 would appear to be artificially raised or floating above the exterior surface 30 of the head 22. With further reference to FIG. 4, the means for attaching 32, may include a fastener system 36 having a bore 38 extending through the exterior surface 30 into the head 22. The bore 38 has narrowed upper passage 40 and terminates in a bulb-shaped cavity 41. A stud 44 projects outwardly from a bottom side 34 of the hair clip 24 and terminates at bulb-shaped end 46. The inner diameter of the passage 40 is less than the diameter of the bulb-shaped end 46 of the stud 44. The exterior diameter of the stud 44 and the interior diameter of the passage 40 may be closely matched such that there is a frictional engagement with the outer surface of the stud and the inner surface of the passage. The hair clip 24 is removably secured to the head 22 by inserting the stud 44 through the bore 38 until the bulb-shaped end 46 is received within the bulb-shaped cavity 42. Either the bulb-shaped end 46 or the head 22 may be of an elastomeric type material that will temporally give to allow the passage of the bulb-shaped end 46 through the passage 40.

Figure 5:
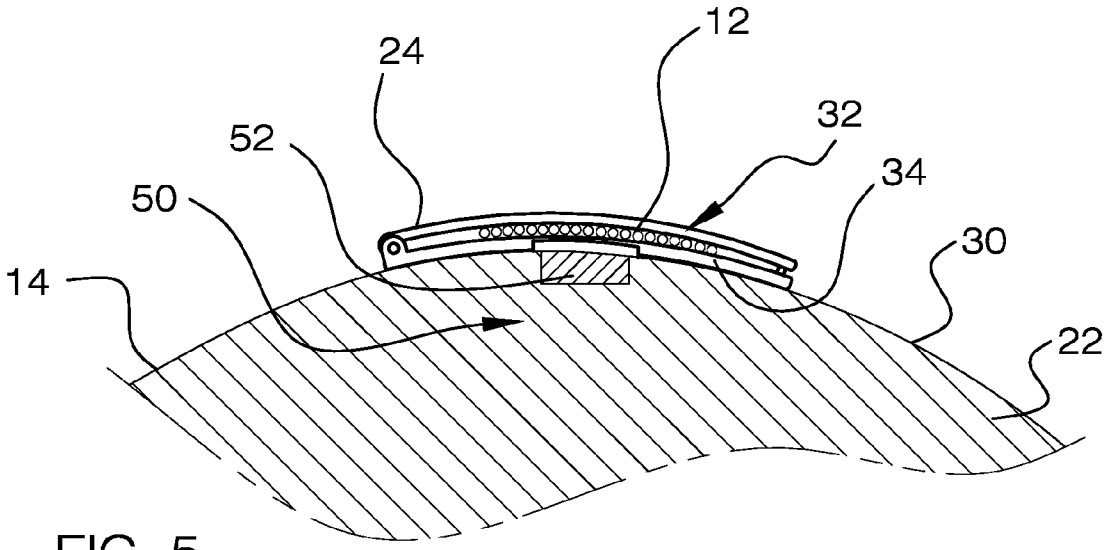
FIG. 5 is an enlarged partial cross section view through a section of the body showing a an alternative fastener system removably securing the hair clip to the body of the apparatus.
Figure 6:
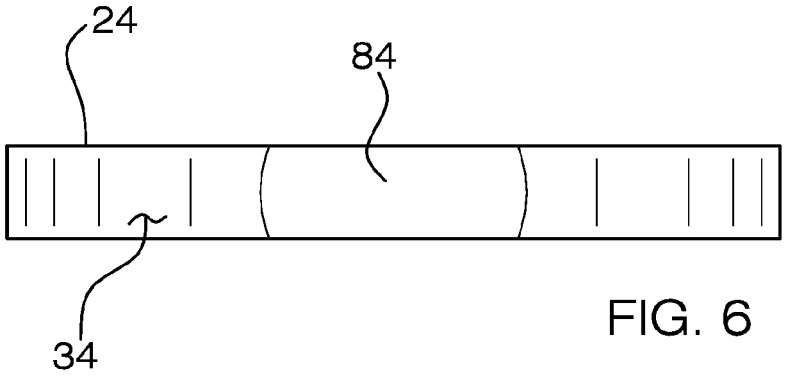
FIG. 6 is a bottom plan view the hair clip including the fastening system of FIG. 5.

Now with reference to FIGS. 5 and 6, the means for attaching 32, may alternatively include a fastener system 50 having a magnetic material, such as magnet 52 that is held by the head 22 at a location below the exterior surface 30 or flush with the exterior surface. A ferrous portion or member 54 may be formed with or attached to the hair clip 24 to which is attracted by the magnet 52, thereby removably attaching the hair clip to the head 22 to display the locket of hair 12. The member 54 may be formed with, attached to or received within a recess of the bottom side 34 of the hair clip 24.

Figure 7:
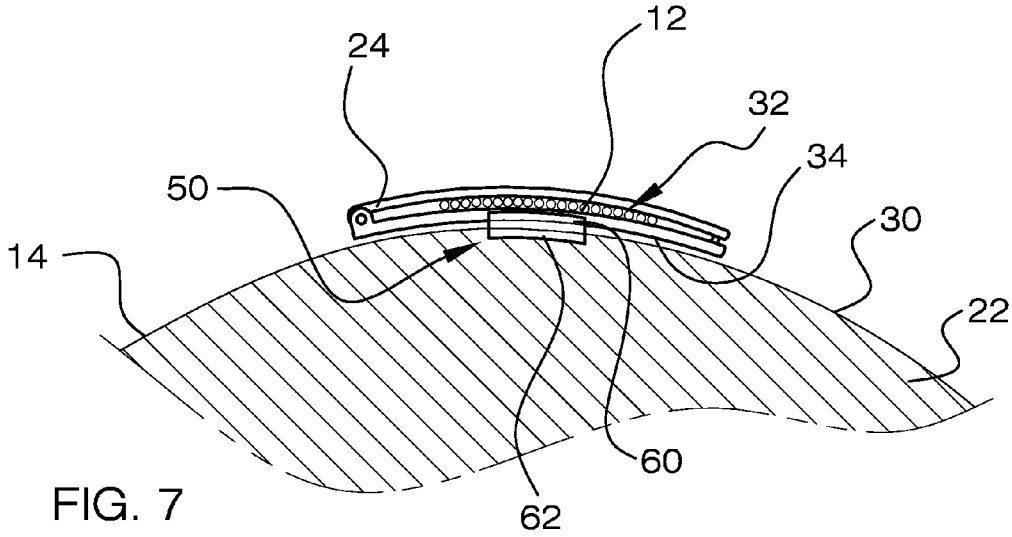
FIG. 7 is an enlarged partial cross section view through a section of the body showing an alternative fastener system removably securing the hair clip to the body of the apparatus.

With reference to FIG. 7, the means for attaching 32, may alternatively include a fastener system 58 having touch fastener including complementary touch fastener elements 60 and 62. The touch fastener may be of the hook and loop type or the like fastener. The fastener elements 60 and 62 may be recessed within the head 22 and the hair clip 24, the fastener elements may be integrally molded with the body and the hair clip or may include a combination of either.

Figure 8:
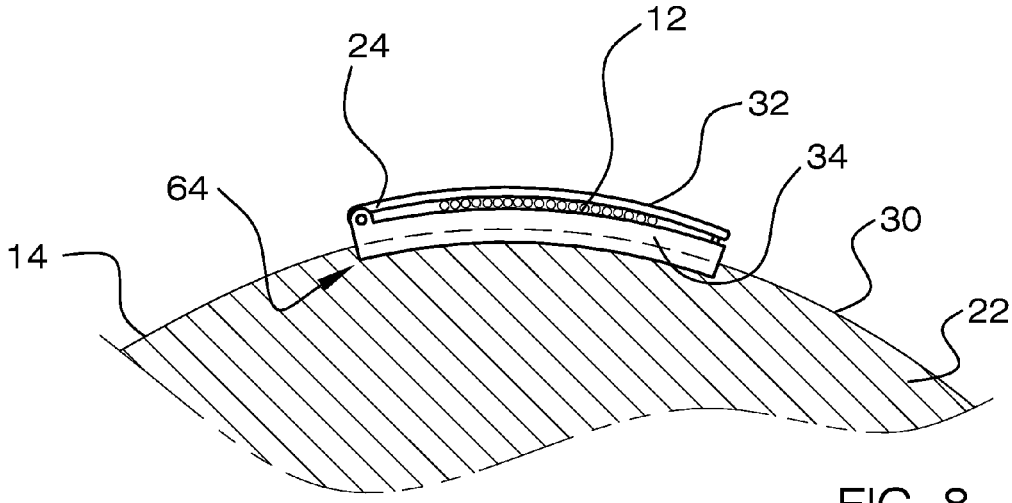
FIG. 8 is an enlarged partial cross section view through a section of the body showing an alternative fastener system integrally molded within the body of the apparatus for pre-attaching the hair clip to the body of the apparatus.

With reference to FIG. 8, the means for attaching 32, may alternatively include a fastener system 64 wherein the hair clip 24 is integral with the body 14 of the apparatus.

A number of embodiments of the present invention have been described. Nevertheless, it will be understood that various modifications may be made without departing from the spirit and scope of the invention. Accordingly, other embodiments are within the scope of the following claims.

What is claimed is:

1. A combination figurine and a locket of hair, the combination comprising:

a figurine body having a torso, a pair of arms, a pair of legs and a head, said body configured to have the appearance of a young child, said head having an exterior surface and a bore extending through said exterior surface at a top portion of said head;

a hair clip having a pair of horizontal clip arms connected together for relative rotation towards and away from each other and a cooperable fastener, said pair of clip arms being rotated away from each other to permit the placement of said locket of hair therebetween and being rotated towards each other to secure said locket of hair therebetween;

said hair clip further including a cooperable fastener securing said pair of clip arms together so as to prevent said pair of clip arms from being rotated away from each other;

one clip arm of said pair of clip arms having a shaft extending from a bottom surface thereof, said shaft being frictionally received by said bore with said bottom surface contiguous with said exterior surface of said head;

said locket of hair being disposed between said pair of clip arms and displayed on said head with opposite ends of said locket of hair being exteriorly disposed relative to said head; and said exterior surface of said head being devoid of hair not forming part of said locket of hair secured by said pair of clip arms.

* * * * *